US009719242B2

(12) United States Patent
Bell et al.

(10) Patent No.: US 9,719,242 B2
(45) Date of Patent: Aug. 1, 2017

(54) NODE FOR A SPACE FRAME

(71) Applicant: Caterpillar Inc., Peoria, IL (US)

(72) Inventors: Jacob W. Bell, Decatur, IL (US); Glenn A. Forthofer, Decatur, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 14/857,959

(22) Filed: Sep. 18, 2015

(65) Prior Publication Data

US 2017/0081837 A1 Mar. 23, 2017

(51) Int. Cl.

| | |
|---|---|
| ***B62D 23/00*** | (2006.01) |
| ***E04B 1/19*** | (2006.01) |
| ***E04B 1/18*** | (2006.01) |

(52) U.S. Cl.

CPC ..... *E04B 1/1903* (2013.01); *E04B 1/185* (2013.01); *E04B 2001/1972* (2013.01); *E04B 2001/1975* (2013.01)

(58) Field of Classification Search

CPC ..... Y10T 403/342; Y10T 403/42; Y10T 403/347; Y10T 403/349; B62D 23/005; B62D 29/008; B62D 21/08; B62D 27/023; F16B 7/0426

See application file for complete search history.

(56) References Cited

U.S. PATENT DOCUMENTS 1,554,224 A * 9/1925 McGrath ..... B64C 1/08 52/646
1,700,319 A * 1/1929 Kjekstad ..... B23K 9/007 16/109
2,150,651 A * 3/1939 Ewing ..... E04F 11/1817 228/164
2,574,249 A * 11/1951 Crowson ..... A01K 87/02 279/23.1
2,798,749 A * 7/1957 Herman ..... A47L 13/24 403/283
3,083,793 A * 4/1963 Brout ..... E04B 1/19 52/222
3,314,673 A 4/1967 Graney et al.
3,406,987 A * 10/1968 Hunder ..... F16L 13/11 138/97
3,902,295 A 9/1975 Yancey
4,014,540 A * 3/1977 Caulkins ..... A63G 9/12 248/341
4,735,355 A 4/1988 Browning
6,010,182 A 1/2000 Townsend
8,328,235 B2 12/2012 Schneider et al.
2010/0244497 A1 9/2010 Honda et al.
2014/0083042 A1* 3/2014 Hiragaki ..... F16B 7/182 52/655.1

FOREIGN PATENT DOCUMENTS

FR 2844862 3/2004

* cited by examiner

*Primary Examiner* — Rodney Mintz
*Assistant Examiner* — Daniel Kenny
(74) *Attorney, Agent, or Firm* — William R. Tinker

(57) ABSTRACT

A space frame includes a plurality of support structures and a node member configured to couple with the plurality of support structures. The node member includes a base portion, a plurality of coupling members extending from the base portion, each of the plurality of coupling members configured to couple with each of the support structures, and a plurality of clamping members configured to couple each of the plurality of coupling members with each of the plurality of support structures.

15 Claims, 4 Drawing Sheets

NODE FOR A SPACE FRAME

TECHNICAL FIELD

The present disclosure relates to a space frame, and more particularly relates to an apparatus for defining a node for the space frame.

BACKGROUND

Generally space frames are used in various industries, such as architecture, construction and any other known industries. The space frame includes multiple support structures and a node at which two or more support structures are coupled to each other. The space frame is used for carrying a load caused by a mass supported on the space frame. The multiple support structures are positioned at various angular positions to provide desired load carrying capacity to the space frame. After a prolonged period of time, the node of the space frame may incur damage due to use. Repairing the damaged node of the space frame at the field application location is a complex and time consuming process.

U.S. Pat. No. 4,735,355 discloses a remotely constructible, three dimensional space frame for a motor vehicle which comprises a plurality of elongated, metal structural members with outer surfaces and having axially uniform cross sections and a plurality of thin walled, interconnecting metal castings of at least first and second types. These metal castings each have (a) a saddle portion for one of the structural members and (b) a receptacle with an elongated tubular portion having a cross section matching the cross section of another structural member. The two structural members are held with respect to each other at a given angle. The saddle portion and tubular portion of the many castings each have outer peripheral edges lying along the outer surface of the two structural members. A welded bead is deposited along these peripheral edges of the two casting portions and between the edges and the two structural members.

SUMMARY OF THE DISCLOSURE

In one aspect of the present disclosure, a space frame is provided. The space frame includes a plurality of support structures and a node member configured to couple with the plurality of support structures. The node member includes a base portion and a plurality of coupling members extending from the base portion. Each of the plurality of coupling members is configured to couple with each of the support structures. The space frame further includes a plurality of clamping members configured to couple each of the plurality of coupling members with each of the plurality of support structures.

In another aspect of the present disclosure, an apparatus for defining a node for a space frame is provided. The apparatus includes a node member including a base portion and a plurality of coupling members extending from the base portion. Each of the plurality of coupling members is configured to couple with each of a plurality of support structures of the space frame. The apparatus further includes a plurality of clamping members configured to couple each of the plurality of coupling members with each of the plurality of support structures.

In yet another aspect of the present disclosure, a method of assembling a space frame having a plurality of support structures is provided. The method includes providing a node member including a base portion and a plurality of coupling members extending from the base portion. The method further includes aligning a connecting end of each of the plurality of coupling members with each of the plurality of support structures by a clamping member. The method further includes welding the clamping member with the support structure and the coupling member.

Other features and aspects of this disclosure will be apparent from the following description and the accompanying drawings.

DETAILED DESCRIPTION

Reference will now be made in detail to specific embodiments or features, examples of which are illustrated in the accompanying drawings. Wherever possible, corresponding or similar reference numbers will be used throughout the drawings to refer to the same or corresponding parts.

Figure 1:
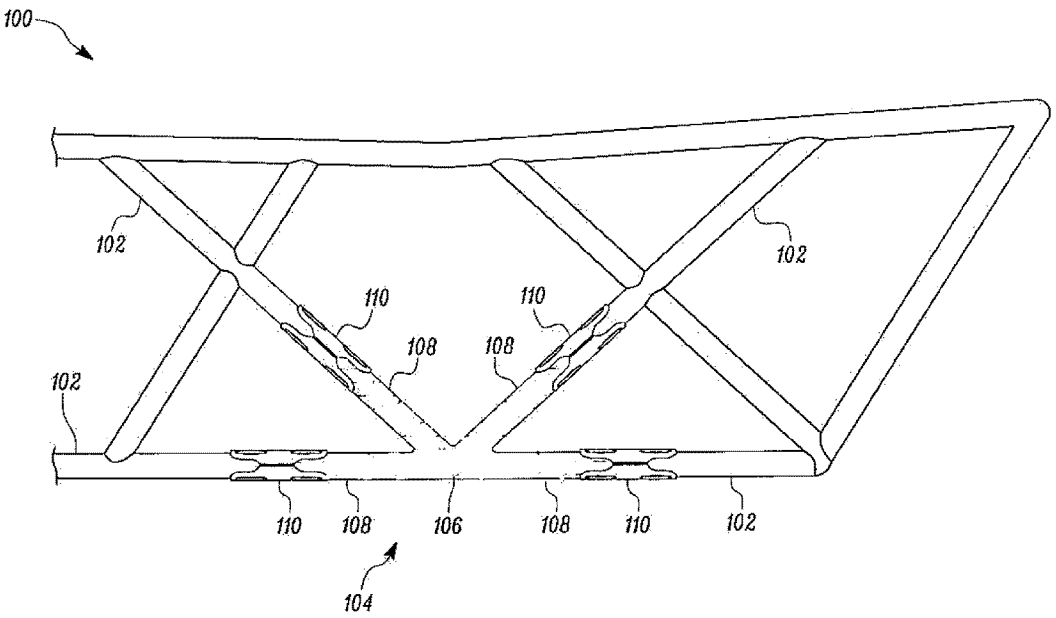
FIG. 1 is a perspective view of a space frame, according to an embodiment of the present disclosure.

FIG. 1 illustrates a perspective view of a space frame 100, according to an embodiment of the present disclosure. The space frame 100 may be used in various applications in industries, such as architecture, construction, mining and any other known industries for supporting loads of various components associated with the application. The space frame 100 may also be used in machines, such as on-road vehicles and off-road vehicles for forming a body and/or implements of the machine. The space frame 100 may also be used for supporting a frame of the machines. In an example, the space frame 100 may be used in drilling operation in a mine area for supporting various components associated with the drilling operations. The space frame 100 includes a plurality of support structures 102. Each of the plurality of support structures 102 are coupled together to form the space frame 100. Further, each of the plurality of support structures 102 may be oriented in various angular positions with respect to adjacent support structures 102 based on a desired load bearing capacity of the space frame 100. The desired load bearing capacity of the space frame 100 may correspond to a permissible load that the space frame 100 may carry for a period of time.

The desired load bearing capacity of the space frame 100 may be directly proportional to various parameters including, but not limited to, number of the support structures 102 of the space frame 100. The support structures 102 may also be used for supporting various components associated with the application in which the space frame 100 is used. The support structures 102 may distribute stresses in the space frame 100 caused by the various components. The space frame 100 further includes a node member 104 configured to couple with the support structures 102 of the space frame 100. As shown in FIG. 1, one node of the space frame 100 is defined by the node member 104 of the present disclosure.

The node member 104 may be configured to position two or more of the plurality support structures 102 in various angular positions.

The node member 104 includes a base portion 106 and a plurality of coupling members 108 extending from the base portion 106. In an example, the base portion 106 may be a casting component. In the illustrated embodiment, the plurality of the coupling members 108 is integrally formed with the base portion 106. In an example, the coupling members 108 may be integrally formed with the base portion 106 using a casting process. In another embodiment, the coupling members 108 are welded to the base portion 106 of the node member 104. In various embodiments, the coupling members 108 may be coupled to the base portion 106 via any fastening method known in the art. Each of the plurality of the coupling members 108 are configured to couple with each of the support structures 102. As shown in FIG. 1, the node member 104 includes four coupling members 108 integrally formed with the base portion 106 to couple with four support structures 102 of the space frame 100. However, it may be contemplated that the node member 104 may include number of coupling members 108 corresponding to the number of support structures 102 to be coupled together. Angular position of each of the coupling members 108 about the base portion 106 may be defined based on a position of each of the support structures 102 in the space frame 100.

The space frame 100 further includes a plurality of clamping members 110 configured to couple each of the plurality of coupling members 108 with each of the plurality of support structures 102. In the illustrated embodiment, each of the clamping members 110 are welded to each of the plurality of coupling members 108 and each of the plurality of support structures 102. In other embodiments, each of the clamping members 110 may be coupled to each of the plurality of coupling members 108 and each of the plurality of support structures 102 via fasteners, such as bolts and nuts.

Figure 2:
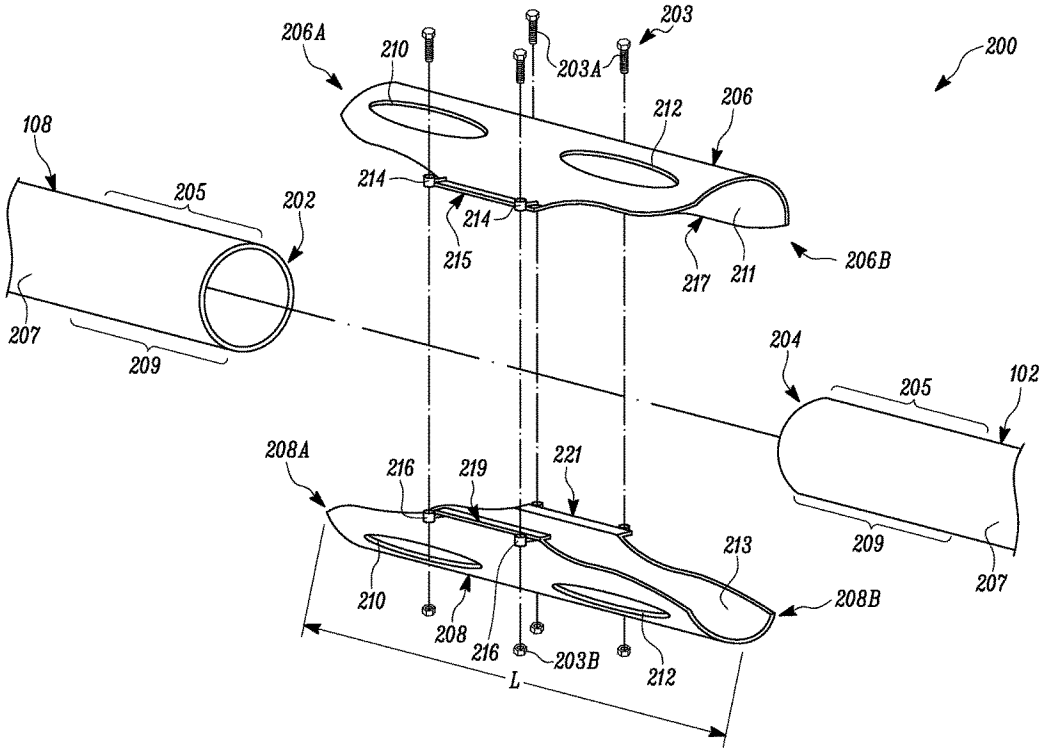
FIG. 2 is an exploded view of an apparatus used for defining a node for the space frame, according to an embodiment of the present disclosure.

FIG. 2 illustrates an exploded view of an apparatus 200 used for defining a node for the space frame 100, according to an embodiment of the present disclosure. The apparatus 200 includes the node member 104 and the plurality of clamping members 110. Coupling of one of the plurality of support structures 102 with one of the plurality of coupling members 108 with one of the plurality of clamping members 110 is illustrated in detail. The coupling member 108 includes a first connecting end 202 configured to couple with the support structure 102. The connecting end 202 is hereinafter referred as 'the first connecting end 202'. Specifically, the first connecting end 202 is configured to couple with a second connecting end 204 of the support structure 102. In the illustrated embodiment, the support structure 102 and the coupling member 108 are cylindrical bodies having circular cross sections.

In one example, an outer diameter of the coupling member 108 adjacent to the first connecting end 202 thereof may be equal to an outer diameter of the support structure 102 adjacent to the second connecting end 204 thereof. In another example, the outer diameter of the coupling member 108 may be less than or greater than the outer diameter of the support structure 102. In other embodiments, a cross section of the coupling member 108 adjacent to the first connecting end 202 thereof may be different from a cross section of the supporting structure adjacent to the second connecting end 204 thereof. The first connecting end 202 of the coupling member 108 and the second connecting end 204 of the support structure 102 are coupled with each other by the clamping member 110.

The clamping member 110 includes a first clamping member 206 and a second clamping member 208 configured to couple with the first clamping member 206 via a fastening member 203. The first clamping member 206 is configured to be disposed on a first portion 205 of an outer surface 207 adjacent to the first connecting end 204 of the coupling member 108 and the second connecting end 206 of the support structure 102. The first clamping member 206 includes a first end 206A and a second end 206B configured to couple to the first connecting end 204 of the coupling member 108 and the second connecting end 206 of the support structure 102, respectively. The first portion 205 of the outer surface of the support structure 102 and the coupling member 108 may correspond to an upper half portion of the outer surface 207 of the support structure 102 and the coupling member 108.

The second clamping member 208 is disposed on a second portion 209 of the outer surface 207 adjacent to the second connecting end 204 of the support structure 102 and the first connecting end 204 of the coupling member 108. The second clamping member 208 includes a first end 208A and a second end 208B configured to couple to the first connecting end 202 of the coupling member 108 and the second connecting end 204 of the support structure 102, respectively. The second portion 209 of the outer surface 207 of the support structure 102 and the coupling member 108 may correspond to a lower half portion of the outer surface 207 of the support structure 102 and the coupling member 108.

Each of the first and second clamping members 206, 208 may have a length 'L' for engaging the first portion 205 and the second portion 209 of the outer surface 207 of the coupling member 108 and the support structure 102. The first portion 205 and the second portion 209 of the outer surface 207 of the coupling member 108 may be engaged by a first half of the length 'L' of the first and second clamping members 206, 208, respectively, and the first portion 205 and the second portion 209 of the outer surface 207 of the support structure 102 may be engaged by a second half of the length 'L' of the first clamping member 206 and second clamping member 208, respectively.

The first clamping member 206 includes an inner surface 211 configured to contact with the outer surface 207 of the coupling member 108 and the support structure 102. Further, the second clamping member 206 includes an inner surface 213 configured to contact with the outer surface 207 of the coupling member 108 and the support structure 102. Thus, the first and second clamping members 206, 208 may be configured to enclose the outer surface 207 adjacent to the second connecting end 204 of the support structure 102 and the first connecting end 204 of the coupling member 108. It may be contemplated that the length 'L' and the inner surfaces 211 and 213 of the first and second clamping members 206, 208 may be defined based on various parameters including, but not limited to, an outer surface area of the coupling member 108 and the support structure 102, cross section of the first and second connecting ends 202,204 of the coupling member 108 and the support structure 102.

Each of the first clamping member 206 and the second clamping member 208 includes a first opening 210 defined adjacent to the first connecting end 202 of the coupling member 108 and a second opening 212 defined adjacent to the second connecting end 204 of the support structure 102. In the illustrated embodiment, each of the first opening 210 and the second opening 212 includes two openings. In other embodiments, the first opening 210 may be defined adjacent to the first connecting end 202 of the coupling member 108 and the second opening 212 may be defined adjacent to the second connecting end 204 of the support structure 102. In the illustrated embodiment, each of the first and second openings 210, 212 has an elliptical cross section. In other embodiments, the cross section of each of the first and second openings 210, 212 may have a square, rectangular, circle, polygonal and/or any other shape known in the art.

As shown in FIG. 1, the apparatus 200 includes a pair of first mounting bosses 214 disposed on each of a first side 215 and a second side 217 of the first clamping member 206 and a pair of second mounting bosses 216 disposed on each of a first side 219 and a second side 221 of the second clamping member 208. In one embodiment, each of the first side 215 and the second side 217 of the first clamping member 206 may include one first mounting boss 214. Correspondingly, each of the first side 219 and the second side 221 of the second clamping member 208 may include one second mounting boss 216.

In another embodiment, the first sides 215, 219 of the first and second clamping members 206, 208, respectively, may be coupled each other by a hinge member such that the first and second clamping members 206, 208 may move about the hinge member. The second sides 217, 221 of the first and second clamping members 206, 208 may include the first and second mounting bosses 214, 216, respectively, to couple the first and second clamping members 206, 208 with the fastening member 203. The first mounting sleeve 214 and the second mounting sleeve 216 may be together arranged to receive the fastening member 203 therethrough. The fastening member 203 includes a bolt 203A and a nut 203B. It may be contemplated that the fastening member 203 may also include, but not limited to, a screw and a rivet. In an alternative embodiment, the first and second mounting bosses 214, 216 may be adapted to receive other fastening members.

Figure 3:
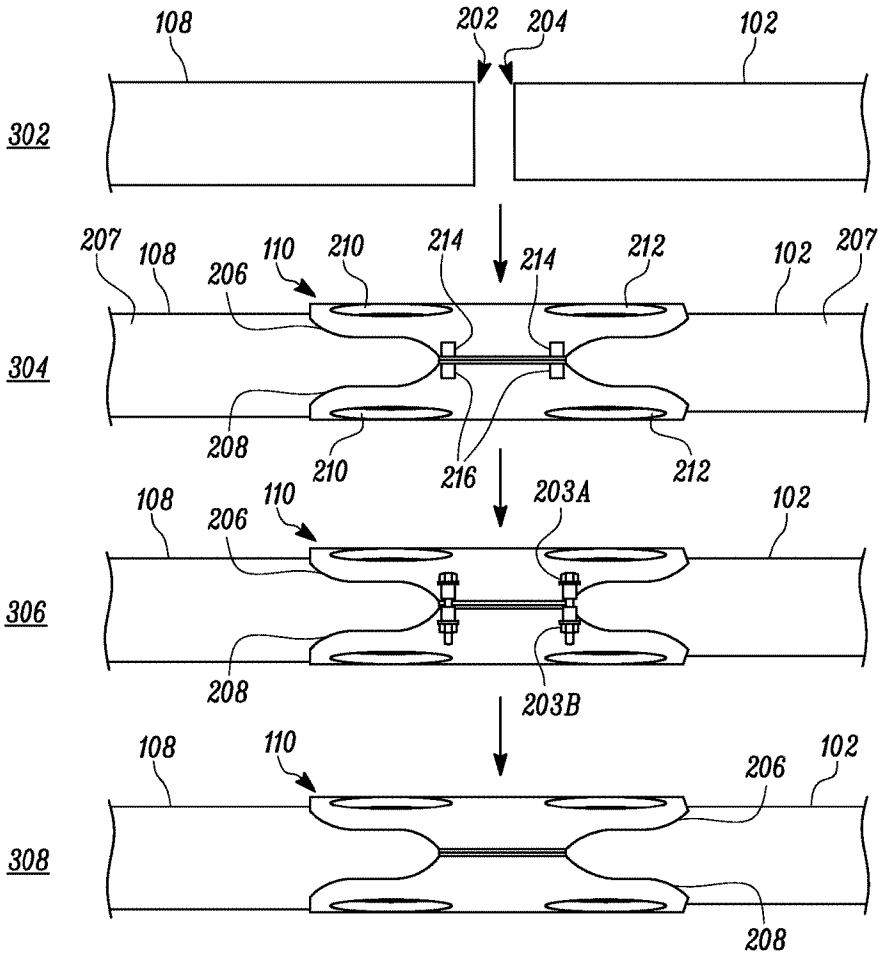
FIG. 3 shows an assembly of a node member with the space frame, according to an embodiment of the present disclosure.

FIG. 3 illustrates a method 300 of assembling the node member 104 with the coupling member 108 and the support structure 102, according to an embodiment of the present disclosure. At step 302, the method 300 includes aligning the first and the second connecting ends 202, 204 of the coupling member 108 and the support structure 102, respectively. Further, the first and the second connecting ends 202, 204 may contact each other. Similarly, the second connecting end 204 of each of the plurality of support structures 102 may be aligned with a corresponding first connecting end 202 of the plurality of coupling members 108.

At step 304, the first connecting end 202 of the coupling member 108 and the second connecting end 204 of the support structure 102 may be coupled with each other by the clamping member 110. The first clamping member 206 is disposed on the first portion 205 of the outer surface 207 of the coupling member 108 and the support structure 102 and the second clamping member 208 is disposed on the second portion 209 of the outer surface 207 of the coupling member 108 and the support structure 102. Further, the inner surfaces 211, 213 of the first and second clamping members 206, 208 may be engaged with the outer surface 207 of the first and second connecting ends 202, 204 of the coupling member 108 and the support structure 102, respectively.

At step 306, the method 300 includes aligning the first and the second mounting bosses 214, 216 of the first clamping member 206 and the second clamping member 208, respectively. The bolt 203A of the fastening member is inserted through each of the first and second mounting bosses 214, 216. The bolt 203A is further engaged with the nut 203B to couple the clamping member 110 with the coupling member 108 and the support structure 102. At step 308, a tack weld is provided between the clamping member 110, the coupling member 108 and the support structure 102. Further, the first and second mounting bosses 214, 216 along with the fastening members are removed from the first and second clamping members 206, 208, respectively. In an example, a cutting tool may be used for removing the first and second mounting bosses 214, 216 from the clamping member 110. Further, the first and the second clamping members 206, 208 are welded to the coupling member 108 by depositing a welding material between the clamping member 110 and the coupling member 108. In the illustrated embodiment, the welding material is deposited within the first opening 210 to couple the clamping member 110 with the coupling member 108.

The welding material may also be deposited around a periphery of the first and second clamping members 206, 208 and the coupling member 108. In other embodiments, welding may be performed at any location between the clamping member 110 and the coupling member 108. Similarly, the first and the second clamping members 206, 208 are welded to the support structure 102 by depositing the welding material between the clamping member 110 and the support structure 102. In the illustrated embodiment, the welding material is deposited within the second opening 212 to couple the clamping member 110 with the support structure 102.

The welding material may also be deposited around a periphery of the first and second clamping members 206, 208 and the support structure 102. In other embodiments, welding may be performed at any location between the clamping member 110 and the support structure 102. Thus, each of the clamping members 110 may be welded with each of the plurality of coupling members 108 and each of the plurality of the support structures 102 of the space frame 100 via a known welding process. In various embodiments, each of the plurality of coupling members 108 and each of the plurality of the support structures 102 may be coupled by each of the clamping members 110 by known fasteners, such as bolts, rivets, and other welding methods known in the art.

INDUSTRIAL APPLICABILITY

The present disclosure relates to the apparatus for defining a node for the space frame 100 and a method 400 of assembling the space frame 100 having the plurality of support structures 102. The nodes for the space frame 100 may be defined by coupling the plurality of support structures 102 with the plurality of coupling members 108 of the node member 104 by the plurality of clamping members 110. According to the present disclosure, during a failure of one or more nodes of the space frame 100, the apparatus including the node member 104 and the clamping members 110 may be used for defining the one or more nodes in a short period of time. The node member 104 may be developed in a manufacturing site in accordance with a desired specification of a structure of the space frame 100.

Figure 4:
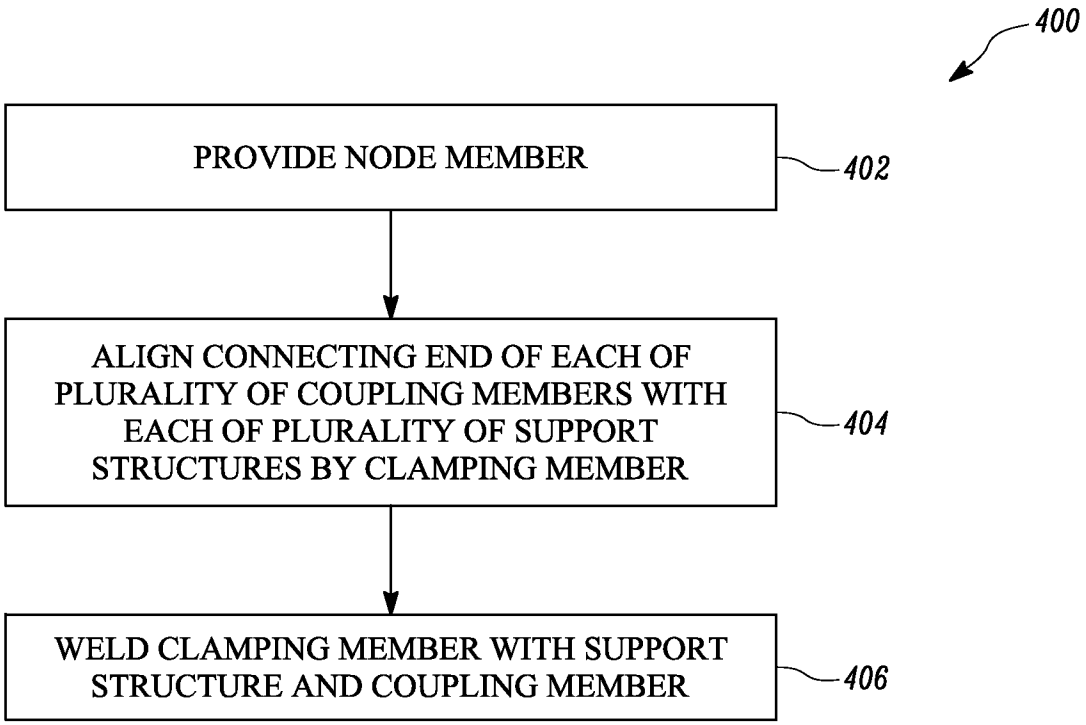
FIG. 4 is a flowchart of a method of assembling the space frame of FIG. 1, according to an embodiment of the present disclosure.

FIG. 4 illustrates a flowchart of the method 400 of assembling the space frame 100, according to an embodiment of the present disclosure. At step 402, the method 400 includes providing the node member 104 including the base portion 106 and the plurality of coupling members 108 extending from the base portion 106. The node member 104 may be developed through a casting process based on a specification defined in relation with a structure of the space frame 100 and an application of the space frame 100. Various angular positions of the plurality of the coupling members 108 with respect to the base portion 106 may be defined based on positions of the support structures 102 of the space frame 100 defining a damaged node that is to be replaced with the node member 104.

At step 404, the method 400 includes aligning the first connecting end 202 of each of the plurality of coupling members 108 with each of the plurality of support structures 102 by the clamping member 110. The node member 104 made in the manufacturing site is taken to location of the space frame 100 structure to replace the damaged node. Each of the plurality of coupling members 108 is aligned with each of the plurality of support structures 102 by disposing each of the first and second clamping members 206, 208 on the first and the second portions 205, 209, respectively, of the outer surface 207 of the support structures 102 and the coupling members 108.

Further, the first mounting boss 214 of the first clamping member 206 and the second mounting boss 216 of the second clamping member 208 may be aligned to receive the fastening member 203. The first mounting boss 214 and the second mounting boss 216 may be further coupled with the fastening members 203. The tack weld is provided between each of the clamping members 110, the coupling members 108 and the support structures 102 of the space frame 100. Further, the first and second mounting bosses 214, 216 along with the fastening member 203 may be removed. At step 406, the method 400 includes welding each of the clamping members 110 with each of the support structures 102 and each of the coupling members 108. The welding material may be deposited through the first opening 210 and the second opening 212 of the first and second clamping members 206, 208 to couple the first and second clamping members 206, 208 with the coupling members 108 and the support structures 102, respectively.

The apparatus 200 of the present disclosure may be adapted for defining a node for various space frames. Further, the apparatus 200 may be taken to a field, where the space frame 100 is located for repairing the damaged node in short period of time. As the welding of the clamping member 110 includes a fillet weld or groove weld, an operator with less skill may be able to weld the clamping member 110 with the coupling member 108 and the support structure 102. Further, maintenance cost associated with repairing of the damaged node may be minimized as the apparatus 200 may be easily transported to the field and the welding operation may be performed with the operator having less skill in the welding operation.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A space frame comprising:

a plurality of support structures;

a node member configured to couple with the plurality of support structures, the node member comprising;

a base portion; and a plurality of coupling members extending from the base portion, each of the plurality of coupling members configured to couple with each of the support structures; and a plurality of clamping members configured to couple each of the plurality of coupling members with each of the plurality of support structures;

wherein each of the coupling members comprises a first connecting end and each of the support structures comprises a second connecting end, and wherein the first connecting end and the second connecting end are coupled with each other by the clamping member;

wherein the clamping member comprises:

a first clamping member disposed on a first portion of an outer surface of the support structure and the coupling member;

a second clamping member disposed on a second portion of the outer surface of the support structure and the coupling member; and wherein each of the first and second clamping members comprises a first opening defined adjacent to the first connecting end of the coupling member and a second opening defined adjacent to the second connecting end of the support structure; and wherein the first and second clamping members are coupled with the coupling member using a welding material, wherein the welding material is received within the first opening.

2. The space frame of claim 1, wherein the plurality of coupling members is welded to the base portion.

3. The space frame of claim 1, wherein the first and second clamping members are coupled with the support structure using the welding material, wherein the welding material is received within the second opening.

4. The space frame of claim 3, wherein the first and second clamping members are coupled with the coupling member using a welding material, wherein the welding material is deposited around a periphery of the first and second clamping members.

5. The space frame of claim 1, wherein the first clamping member includes a length, wherein the first portion of the outer surface of the coupling member is engaged by a first half of the length of the first clamping member and the first portion of the outer surface of the support structure is engaged by a second half of the length of the first clamping member.

6. The space frame of claim 5, wherein the second clamping member includes a length, wherein the second portion of the outer surface of the coupling member is engaged by a first half of the length of the second clamping member and the second portion of the outer surface of the support structure is engaged by a second half of the length of the second clamping member.

7. The space frame of claim 1, wherein each of the plurality of support structures are oriented in angular positions with adjacent support structures of the plurality of support structures to distribute stress in the space frame.

8. The space frame of claim 7, wherein angular positions of each of the plurality of coupling members about the base portion are defined based on the angular positions of each of the plurality of support structures.

9. An apparatus for defining a node for a space frame, the apparatus comprising:

a node member;

a plurality of clamping members, each of the plurality of clamping members including a first clamping member and a second clamping member, each of the first clamping member and a second clamping member including a first opening and a second opening;

the node member including:

a base portion; and a plurality of coupling members extending from the base portion, each of the plurality of coupling members configured to couple with each of a plurality of support structures of the space frame; and the plurality of clamping members configured to couple each of the plurality of coupling members with each of the plurality of support structures;

wherein each of the plurality of coupling members includes a first connecting end and each of the plurality of support structures includes a second connecting end, and wherein the first connecting end and the second connecting end are coupled with each other by a first clamping member disposed on a first portion of an outer surface of the support structure and the coupling member, and a second clamping member disposed on a second portion of the outer surface of the support structure and the coupling member; and wherein the first and second clamping members are coupled with the coupling member using a welding material, wherein the welding material is received within the first opening of the first and second clamping members defined adjacent to the first connecting end of the coupling member and the second opening of the first and second clamping members defined adjacent to the second connecting end of the support structure.

10. The apparatus of claim 9, wherein the plurality of coupling members is welded to the base portion.

11. The apparatus of claim 9, wherein each of the plurality of support structures are oriented in angular positions with adjacent support structures of the plurality of support structures to distribute stress in the space frame.

12. The apparatus of claim 11, wherein angular positions of each of the plurality of coupling members about the base portion are defined based on the angular positions of each of the plurality of support structures.

13. A method of assembling a space frame, the method comprising:

providing a plurality of support structures, each of the plurality of support structures including a connecting end, an outer surface, a first portion of the outer surface of the support structure, and a second portion of the outer surface of the support structure, the first portion and second portion adjacent to the connecting end of the support structure;

providing a node member including:

a base portion; and a plurality of coupling members extending from the base portion, each of the plurality of coupling members including a connecting end, an outer surface, a first portion of the outer surface of the coupling member, and a second portion of the outer surface of the coupling member, the first portion and second portion adjacent to the connecting end of the coupling member;

providing a plurality of clamping members, each of the plurality of clamping members including a first clamping member and a second clamping member, each of the first clamping member and a second clamping member including a first opening and a second opening;

aligning the connecting end of each of the plurality of coupling members with the connecting end of each of the plurality of support structures;

coupling each of the plurality of coupling members with each of the plurality of support structures with the plurality of clamping members by disposing the first clamping member on the first portion of the outer surface of the coupling member and the support structure and disposing the second clamping member on the second portion of the outer surface of the coupling member and the support structure; and depositing welding material within the first opening of the first and second clamping members defined adjacent to the connecting end of the coupling member and the second opening of the first and second clamping members defined adjacent to the second connecting end of the support structure.

14. The method of claim 13, further comprising depositing welding material within the second opening of the first and second clamping members defined adjacent to the second connecting end of the support structure.

15. The method of claim 14, further comprising depositing welding material around a periphery of the first and second clamping members.

* * * * *